US012656049B2

(12) United States Patent
Cöp et al.

(10) Patent No.: US 12,656,049 B2
(45) Date of Patent: Jun. 16, 2026

(54) COOLING DEVICE HAVING A HEATING ELEMENT PROVIDED ON A MAGNETIC ELEMENT

(71) Applicant: BSH Hausgeräte GmbH, Munich (DE)

(72) Inventors: Burak Cöp, Tekirdag (TR); Necati Bora Gürel, Augsburg (DE); Gürcan Durmaz, Tekirdag (TR); Erdem Sümer, Tekirdag (TR)

(73) Assignee: BSH Hausgeräte GmbH, Munich (DE)

( * ) Notice: Subject to any disclaimer, the term of this patent is extended or adjusted under 35 U.S.C. 154(b) by 150 days.

(21) Appl. No.: 18/426,430

(22) Filed: Jan. 30, 2024

(65) Prior Publication Data

US 2024/0255210 A1 Aug. 1, 2024

(30) Foreign Application Priority Data

Jan. 30, 2023 (TR) ..... 2023/001055

(51) Int. Cl.
*F25D 23/02* (2006.01)
*F25D 23/08* (2006.01)

(52) U.S. Cl.
CPC ..... *F25D 23/028* (2013.01); *F25D 23/08* (2013.01); *F25D 2323/002* (2013.01)

(58) Field of Classification Search
CPC .. F25D 23/028; F25D 23/08; F25D 2323/002; F25D 21/04
See application file for complete search history.

(56) References Cited

U.S. PATENT DOCUMENTS 4,330,310 A * 5/1982 Tate, Jr. ..... F25D 23/082 62/275
4,884,415 A * 12/1989 Mandel ..... F25D 21/04 62/277
5,255,531 A * 10/1993 Williams ..... F25D 23/028 62/277
6,036,294 A * 3/2000 Banicevic ..... F25D 23/069 312/407
6,266,970 B1 * 7/2001 Nam ..... F25D 23/028 62/277
6,464,312 B1 * 10/2002 Tenhundfeld ..... E05C 19/161 49/478.1
10,563,905 B1 * 2/2020 Allard ..... F25D 23/085
(Continued)

FOREIGN PATENT DOCUMENTS

DE 102017202050 A1 * 8/2018 ..... F25D 23/00
EP 1079187 A1 2/2001
EP 1076210 B1 * 6/2013 ..... F24C 15/045

*Primary Examiner* — Frantz F Jules
*Assistant Examiner* — Emmanual E Duke
(74) *Attorney, Agent, or Firm* — Laurence A. Greenberg; Werner H. Stemer; Ralph E. Locher

(57) ABSTRACT

A cooling device contains a body having a front flange, a body enclosing a storage compartment and a door operatively associated with the body for opening and closing an access opening of the storage compartment. A sealing element seals an area between the body and the door. A magnetic element is in contact with or attached to the front flange. A heating element is at least partially in contact with the magnetic element. The cooling device further contains at least one holding element defining a space for at least partly surrounding both the heating element and the magnetic element in a tight manner.

14 Claims, 5 Drawing Sheets

(56) References Cited

U.S. PATENT DOCUMENTS

| | | | | |
|---|---|---|---|---|
| 11,635,249 | B1 * | 4/2023 | Karl | E05C 19/161 29/890.035 |
| 2004/0104654 | A1 * | 6/2004 | Lee | F25D 23/10 312/401 |
| 2004/0189165 | A1 * | 9/2004 | An | E05C 19/161 312/405 |
| 2007/0011950 | A1 * | 1/2007 | Wood | F25D 23/087 49/478.1 |
| 2013/0257256 | A1 * | 10/2013 | Allard | F25D 23/065 29/525.01 |
| 2015/0192347 | A1 * | 7/2015 | Cho | F25D 21/04 62/272 |
| 2020/0041196 | A1 * | 2/2020 | Heckler | F25D 23/087 |
| 2020/0263919 | A1 * | 8/2020 | Stewart | F25D 23/085 |
| 2021/0172674 | A1 * | 6/2021 | Basarir | E05C 19/161 |

* cited by examiner

COOLING DEVICE HAVING A HEATING ELEMENT PROVIDED ON A MAGNETIC ELEMENT

CROSS-REFERENCE TO RELATED APPLICATION

This application claims the priority, under 35 U.S.C. § 119, of Turkish Patent Application TR2023/001055, filed Jan. 30, 2023; the prior application is herewith incorporated by reference in its entirety.

FIELD AND BACKGROUND OF THE INVENTION

The present invention relates to a cooling device according to the preamble of the independent claim.

Cooling devices are needed for keeping food fresh for a predetermined period by reducing the temperature of a cooling compartment and a freezing compartment. The access to any food compartment of the cooling device may be realized by opening a door which is rotatably mounted in a body. A gasket provided as a sealing assembly in cooling devices can be used as a mechanical seal which fills a space between two or more mating surfaces, generally to prevent leakage. It is well known that cooling devices are constructed in such a manner that the outer surfaces of the compartment along the sealed edges of the doors are cooled to a temperature below the dew point of the surrounding air. That causes the moisture in the air to condense along the exterior edge of the door or along the front flange of the cooling device. In the prior art, sealing assembly structures are used with heating elements in the form of a tube which forms part of the refrigeration cycle. Especially under high temperature and humidity conditions, condensation may form on the outer surface of the sealing assembly relative to the low temperature in the cooling compartments. It is known that the heating element is provided in the front flange of the body so as to minimize any such condensation of moisture due to any temperature difference between the compartments and the outside air. Despite the use of heating elements in cooling devices, condensation may still occur on a flat outer wall of the front flange. Furthermore, the assembly process of the heating element needs to be more rigid. Thus, there is a need for an improved heating performance with more efficient construction.

Published, European patent application EP 1079187 A1, corresponding to U.S. Pat. No. 6,266,970, discloses a vertical partition cover assembly for a side-by-side refrigerator which includes a cover coupled to the front of the vertical partition and a fixing member for fixing a heater tube to the inside of the cover. The cover has a sealing surface to contact gaskets on doors and mounting means attach the sealing surface to the front of the vertical partition. In one embodiment, the mounting means includes connecting portions extending inwardly from both ends of the sealing surface, and a pair of pocket portions formed at each end of the connecting portions to hold the front ends of liners forming the vertical partition. A fixing member having a concave portion in which a heater tube is located hold the tube in contact with the sealing surface and includes a pair of resilient portions which extend to the inside of the vertical partition from both ends of the concave portion and resiliently engage with the inner ends of the respective pocket portions.

SUMMARY OF THE INVENTION

An object of the present invention is to provide a cooling device provided with a heating element which is fixed in a more stable manner in order to prevent occurring condensation on the front flange.

The present invention proposes a cooling device containing a body having a front flange, wherein the body encloses a storage compartment, a door operatively associated with the body for opening and closing an access opening of the storage compartment, a sealing element for sealing an area between the body and the door, a magnetic element which is in contact with or attached to the front flange, and a heating element being at least partially in contact with the magnetic element. The cooling device further contains at least one holding element defining a space for at least partly surrounding both the heating element and the magnetic element in a tight manner. Therefore, the heating element is held in a desired position on the magnetic element. Thus, sweating is prevented on the sealing element. Besides, the magnetic element is fixed on the front flange firmly.

In a possible embodiment of the invention, the holding element is arranged to define a first space portion having a first height for holding both the heating element and the magnetic element therein. Therefore, the heating element is supported by the wall which encloses the first space portion at least partly in such a way that the heating element is held on the magnetic element. Besides, the movement of the heating element on the magnetic element is limited by the wall which encloses the first space portion at least partly.

In a possible embodiment of the invention, the holding element is arranged to define a second space portion having a second height smaller than the first height, for holding only a part of the magnetic element. Therefore, the magnetic element is fixed on the front flange firmly.

In a possible embodiment of the invention, the magnetic element has a thickness arranged in such a way that the heating element is locating between the magnetic element and a wall of the holding element on a first side, and the magnetic element fills the second space portion on a second side. Therefore, the magnetic element is supported by the wall enclosing the second space portion at least partly in such a way that the magnetic element is fixed on the front flange. Besides, the heating element is supported by both the wall enclosing the first space portion and the magnetic element in order to fix the heating element.

In a possible embodiment of the invention, the front flange comprises a front wall facing the door and having an inner planar surface whereon the magnetic element is disposed, and wherein the front wall has an outer planar surface in contact with the sealing element when the door closes the access opening. Therefore, the magnetic element does not directly contact with the sealing element.

In a possible embodiment of the invention, both the heating element and the magnetic element extend on a portion of the inner planar surface in a vertical direction of the cooling device. Therefore, the front flange is prevented from occurring condensation while the sealing performance is increased, in the vertical direction.

In a possible embodiment of the invention, both the heating element and the magnetic element extend on a portion of the inner planar surface in a horizontal direction of the cooling device. Therefore, the front flange is prevented from occurring condensation while the sealing performance is increased, in the horizontal direction.

In a possible embodiment of the invention, the holding element has a first fixing portion which is substantially parallel to the front wall, for fixing the holding element to the inner planar surface at one side. Therefore, the holding element is fixed to the front wall in a firm manner. The holding element may be fixed to the front wall from the first fixing portion by using any mechanical fastening elements such as screws.

In a possible embodiment of the invention, the holding element has a second fixing portion provided at the opposite side of the first fixing portion for fixing the holding element to the inner planar surface. Therefore, the holding element is fixed to the front wall in a firmer manner.

In a possible embodiment of the invention, an adhesive means is provided between the first fixing portion and the inner planar surface or between second fixing portion and the inner planar surface. Therefore, fixing the holding element to the front wall is made easier. Thus, man hour is reduced for producing the cooling device having the holding element.

In a possible embodiment of the invention, the adhesive mean is a double-sided tape. Therefore, the holding element may be easily attached to the front wall. Besides, the holding element is fixed to the front wall firmly.

In a possible embodiment of the invention, a plurality of holding elements are provided on the heating element. Therefore, the heating element is fixed on the magnetic element tightly.

In a possible embodiment of the invention, the heating element is a metal tube which transfers heat. Thus, condensation problems on the sealing assembly and the front flange are prevented with increased efficiency.

In a possible embodiment of the invention, the holding element is made of a plastic material such as EPS. Therefore, the heating element is fixed on the magnetic element in a cost-efficient manner.

In this document, "X-direction" corresponds to a vertical direction of the cooling device, the body and the front flange.

In this document, "Y-direction" corresponds to a horizontal direction of the cooling device, the body and the front flange.

Other features which are considered as characteristic for the invention are set forth in the appended claims.

Although the invention is illustrated and described herein as embodied in a cooling device having a heating element provided on a magnetic element, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
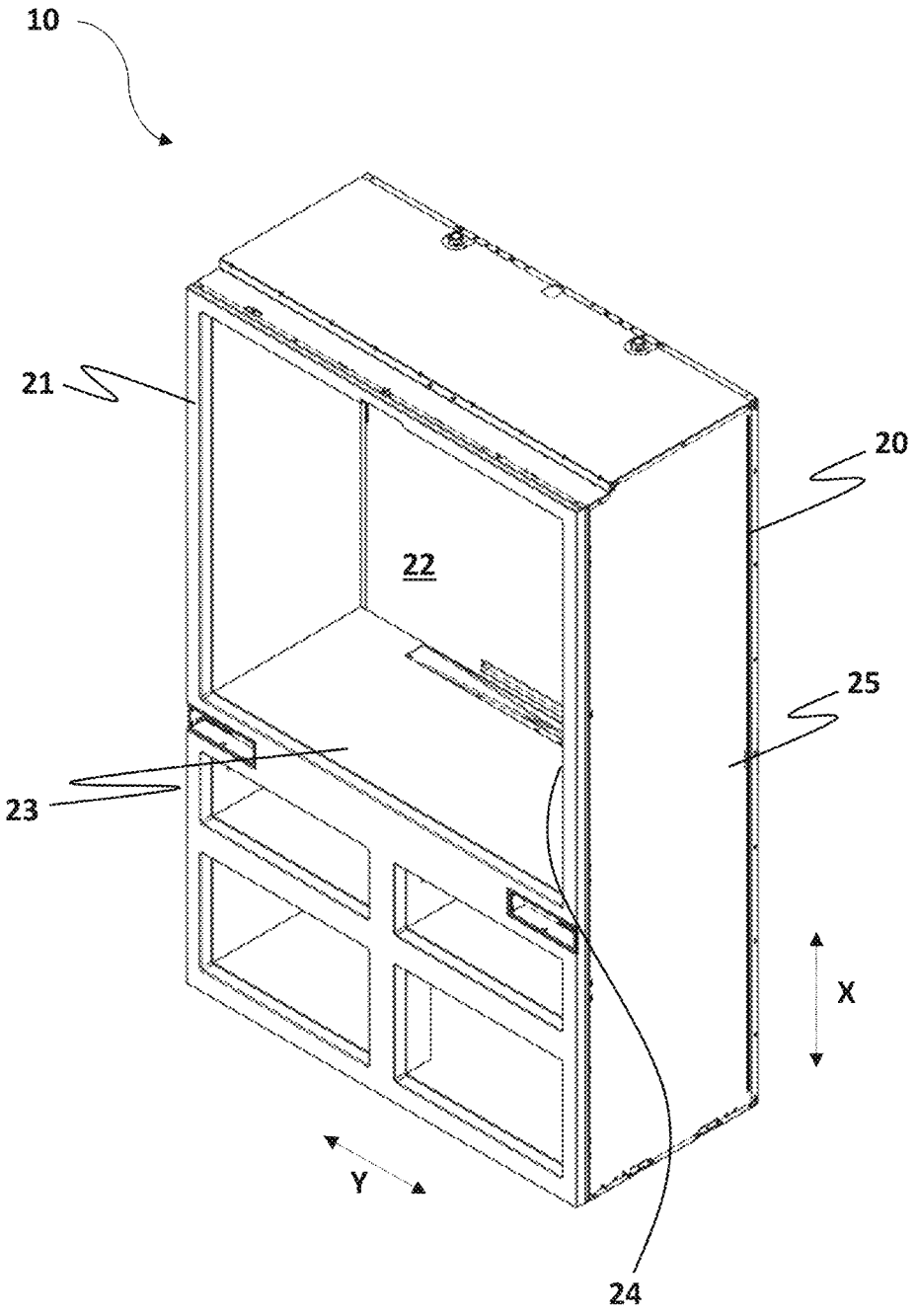
FIG. 1 is a diagrammatic, perspective view of a cooling device without doors, according to the present invention.
Figure 4:
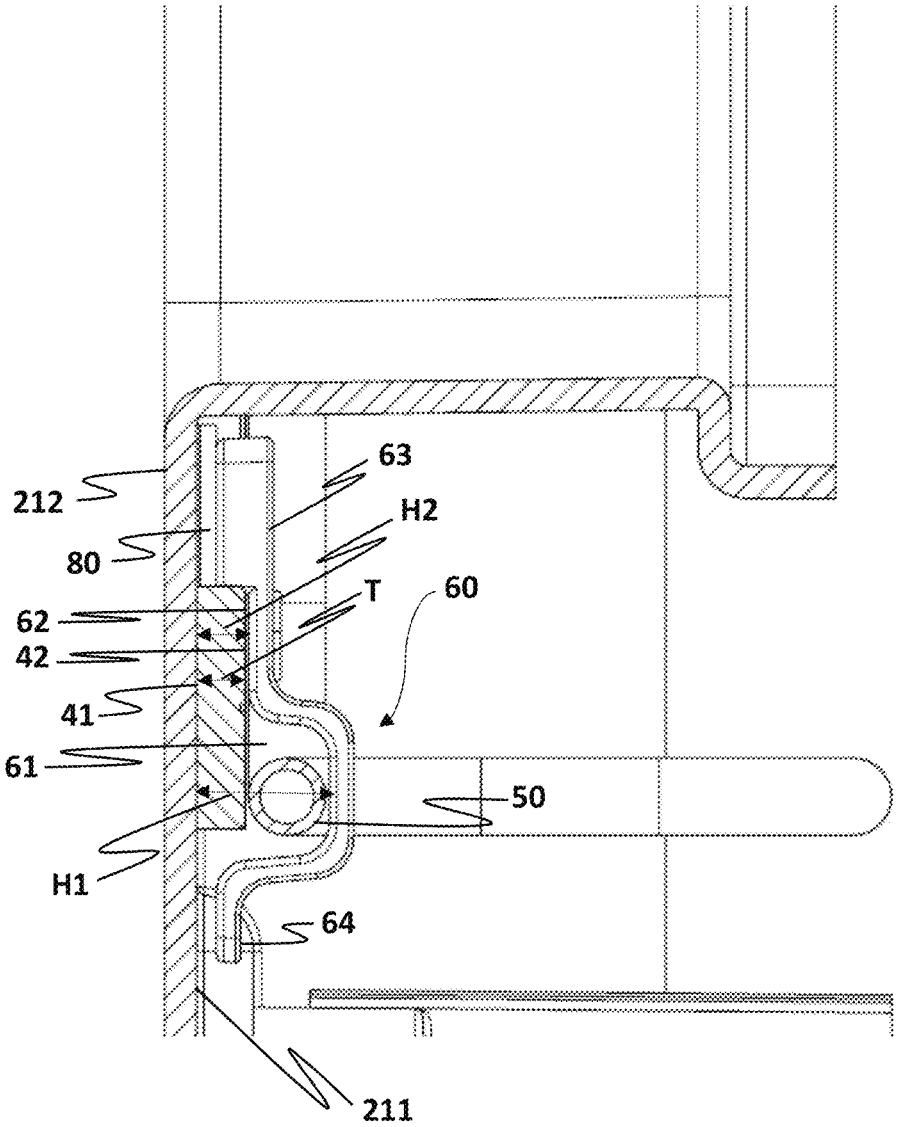
FIG. 4 is a side, cross-sectional view of the front wall, according to the present invention.
Figure 5:
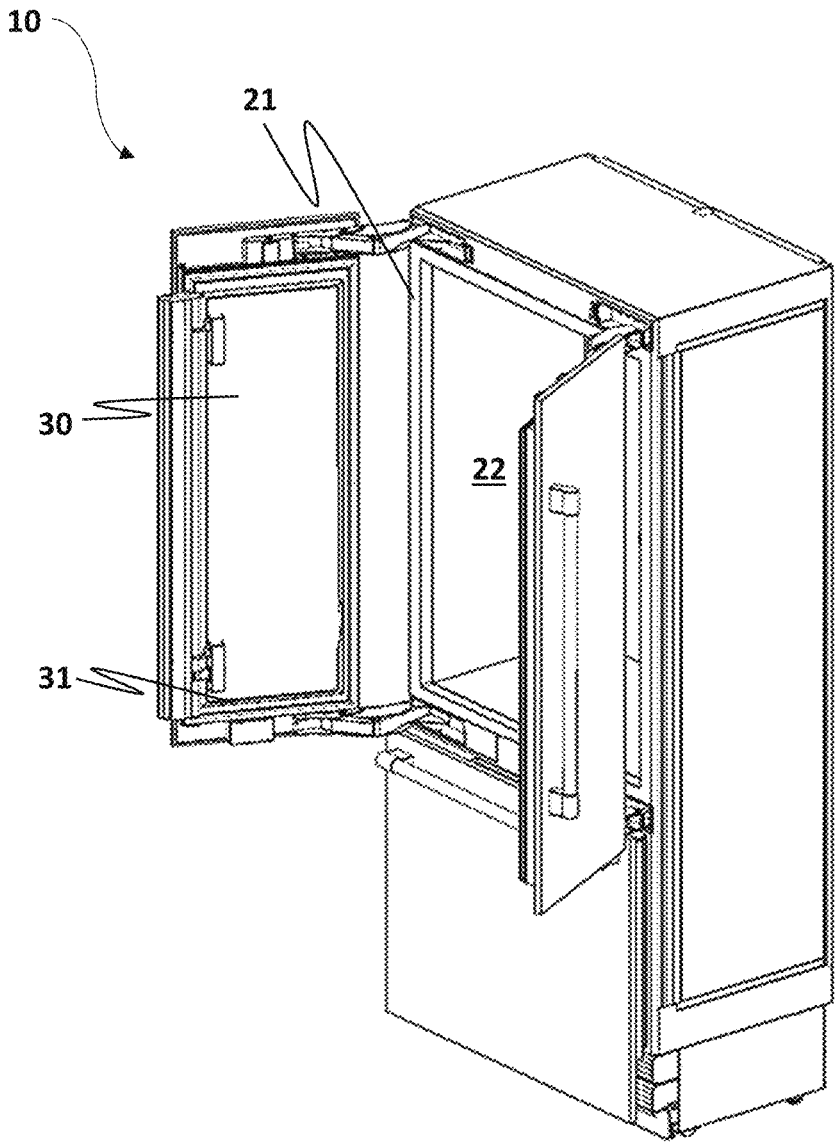
FIG. 5 is a perspective view of the cooling device with doors, according to the present invention.

Referring now to the figures of the drawings in detail and first, particularly to FIG. 1 thereof, there is shown a cooling device 10 containing a body 20 having a front flange 21. The body 20 encloses a storage compartment 22. As seen in FIG. 1, the body 20 contains an access opening 23 at a front side of the cooling device 10 for accessing the storage compartment 22 from outside. The front flange 21 is provided at the front side of the cooling device 10. The front flange 21 connects to the inner sidewall 24 of the body 20 facing the storage compartment 22, at a first side. At a second side opposite to the first side, the front flange 21 connects to the outer sidewall 25 of the body 20. When the front flange 21 connected to the outer sidewall 25 and the inner sidewall 24, at least a portion of the front flange 21, can be visible from the front side of the cooling device 10. As seen in FIG. 5, at least one door 30 hinged to the body 20 is provided for selectively covering the access opening 23. In FIG. 5, the exemplary cooling device 10 contains a pair of doors hinged to the body 20. The door 30 has a closed position in which the access opening 23 is closed. The door 30 can be in an open position which enables the user to reach into the storage compartment 22 via the access opening 23. As seen in FIG. 5, a sealing element 31 is provided on the door 30. When the doors 30 are at the closed position, the sealing element 31 is between the doors 30 and the body 20. A magnetic element 40 which is in contact with or attached to the front flange 21 is provided. A heating element 50 is at least partially in contact with the magnetic element 40. The cooling device 10 further contains at least one holding element 60 defining a space 70 for at least partly surrounding both the heating element 50 and the magnetic element 40 in a tightly manner. The magnetic element 40 has a first surface 41 facing to the front flange 21. As shown in FIG. 4, the magnetic element 40 has a second surface 42 which is opposite to the first surface. The heating element 50 is provided on the second surface 42 of the magnetic element 40. The holding element 60 covers the second surface 42 of the magnetic element 40. In another words, the heating element 50 is fixed between the holding element 60 and the second surface 42 of the magnetic element 40. Therefore, the heating element 50 on the magnetic element 40 is prevented from moving when the cooling device 10 is moved. As seen in FIG. 5, the cooling device 10 can a drawer-type door containing a door and a drawer (not shown) integrated to the door. Similarly, the drawer-type door also has a sealing element which can be in contact with the front flange 21, when the drawer-type door is at the closed position.

Referring to FIG. 4, the holding element 60 is arranged to define a first space portion 61 having a first height H1 for holding both the heating element 50 and the magnetic element 40 therein. The first space portion 61 is a portion which is between the holding element 60 and the front flange 21. The first space portion 61 has a concave cross-sectional shape. The magnetic element 40 and the heating element 50 on the second surface 42 of the magnetic element 40 are held inside the first space portion 61.

Referring to FIG. 4, the holding element 60 is arranged to define a second space portion 62. The second space portion 62 has a second height H2 which is smaller than the first height H1, for holding only a part of the magnetic element 40. The magnetic element 40 is squeezed between the wall of the second space portion 62 and the front flange 21. At least a portion of the wall of the second space portion 62 extends along the second surface 42 of the magnetic element 40.

Figure 3:
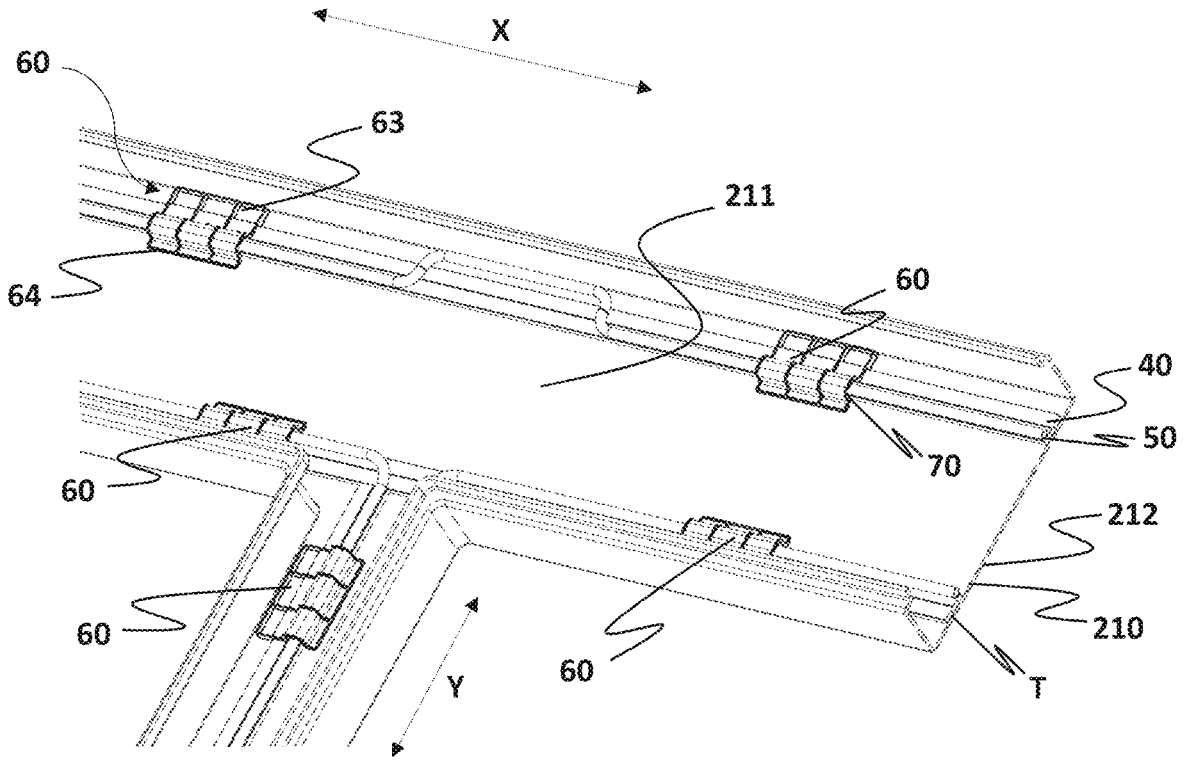
FIG. 3 is a detailed perspective view of an inner planar surface of a front wall, according to the present invention.

Referring to FIG. 3 and FIG. 4, wherein the magnetic element 40 has a thickness T arranged in such a way that the heating element 50 is locating between the magnetic element 40 and a wall of the holding element 60 on a first side. The first height H1 approximately equals the sum of the thickness T of the magnetic element 40 and the diameter of the heating element 50. The magnetic element 40 is filling the second space portion 62 on a second side. The second height H2 approximately equals the thickness T of the magnetic element 40.

Referring to FIG. 3, FIG. 4 and FIG. 5, the front flange 21 contains a front wall 210 facing the door 30 and having an inner planar surface 211 whereon the magnetic element 40 is disposed. The front wall 210 has an outer planar surface 212 in contact with the sealing element 31 when the door 30 closes the access opening 23. In other words, the outer planar surface 212 faces the door 30 when the door 30 closes the access opening 23. The inner planar surface 211 is opposite surface of the outer planar surface 212. There is a further magnetic element (not shown) is encased within a magnetic member housing (not shown) of the sealing element 31. The magnetic element 40 and further magnetic element can be made of any material which can be confined by the magnetic force, that is, the material (ferromagnetic member) magnetizable by the magnetic force. The magnetic element 40 and further magnetic element are dual pole magnets.

Figure 2:
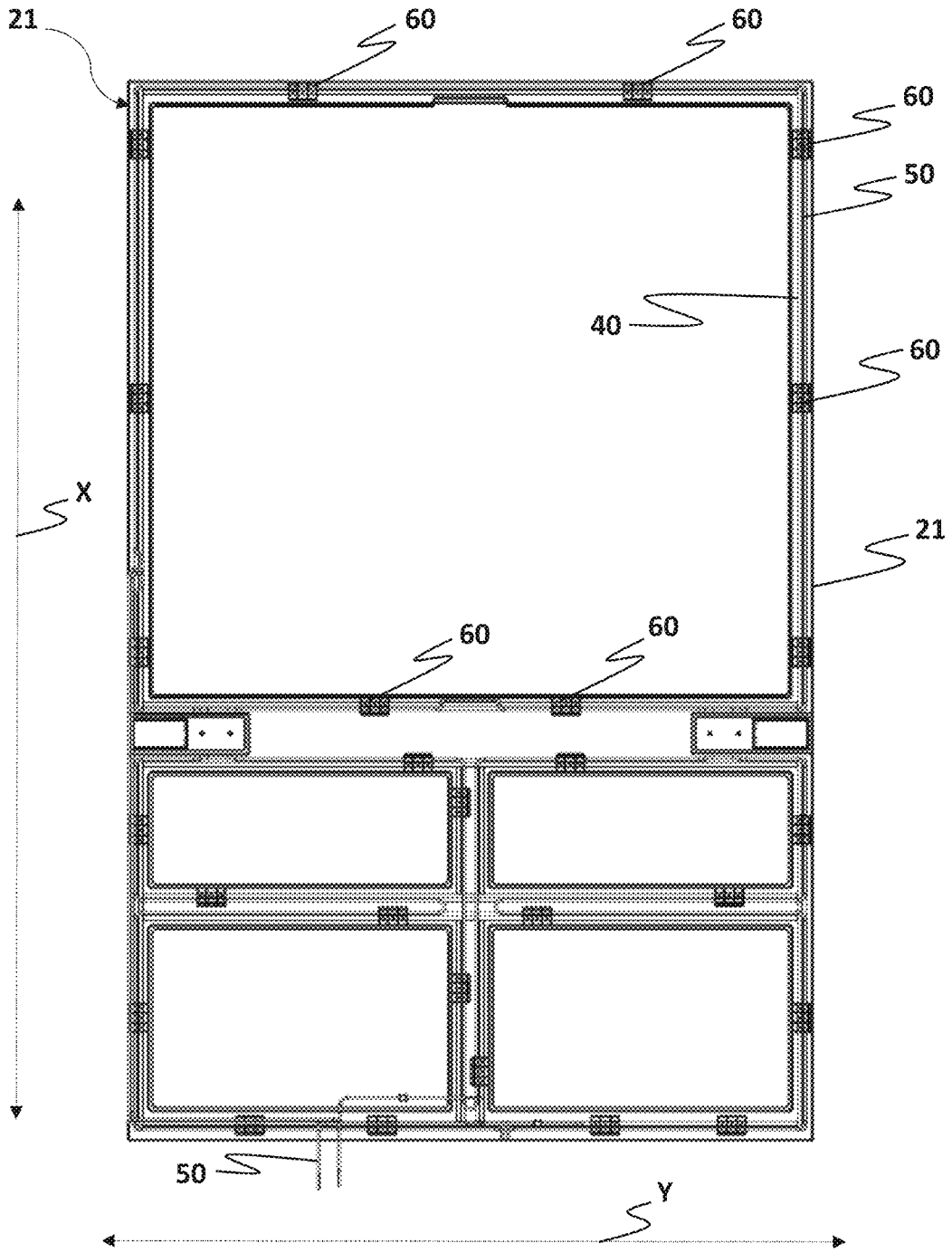
FIG. 2 is a front view of a rear side of a front flange provided with holding elements, according to the present invention.

Referring to FIG. 2, both the heating element 50 and the magnetic element 40 extend on a portion of the inner planar surface 211 in a vertical direction X of the cooling device 10. The magnetic element 40 extends along the inner planar surface 211. Therefore, sealing performance of the sealing element 31 is increased. The heating element 50 extends along the second surface 42 of the magnetic element 40. In a preferred embodiment of the present invention, both the heating element 50 and the magnetic element 40 extend on a portion of the inner planar surface 211 in a horizontal direction Y of the cooling device 10.

Referring to FIG. 4, the holding element 60 has a first fixing portion 63 which is substantially parallel to the front wall 210, for fixing the holding element 60 to the inner planar surface 211 at one side. The holding element 60 is fixed to the front wall 210 from the first fixing portion 63. The second space portion 62 extends from the first fixing portion 63. The second space portion 62 is between the first space portion 61 and the second space portion 62. In a preferred embodiment of the present invention, as seen in FIG. 4, the holding element 60 is fixed to the front wall 210 from only one side of the holding element 60.

Referring to FIG. 3, the holding element 60 has a second fixing portion 64 for fixing the holding element 60 to the inner planar surface 211. The second fixing portion 64 is provided at the opposite side of the first fixing portion 63. The first space portion 61 and the second space portion 62 are between the first fixing portion 63 and the second fixing portion 64.

Referring to FIG. 4, an adhesive means 80 is provided between the first fixing portion 63 and the inner planar surface 211. The adhesive means 80 is provided between second fixing portion 64 and the inner planar surface 211. The adhesive means 80 extends along the contact surface which is planar surface where the fixing portions 63,64 and the inner planar surface 211 contact.

Referring to FIG. 4, the adhesive means 80 is being a double-sided tape. First, the double-sided tape is attached to the front wall 210. Then, one of the fixing portions 63,64 is attached to the double-sided tape. Therefore, the holding element 60 is easily attached to the front wall 210.

Referring to FIG. 2 and FIG. 3, a plurality of holding elements 60 are provided on the heating element 50. At least two holding elements 60 are provided in the horizontal direction Y of the front wall 210. At least two holding elements 60 are provided in the vertical direction X of the front wall 210.

Referring to FIG. 3 and FIG. 4, the heating element 50 is a metal tube which transfers heat. The heating element 50 is preferably copper and is disposed to carry condenser fluid between components of the cooling system of the cooling device 10. The heating element 50 is disposed to circulate heated condenser fluid from the cooling mechanism along the front flange 21, thereby helping to keep the front flange 21 above the ambient air dew point and reducing or eliminating water formation on the front flange 21 and the sealing element 31.

The holding element 60 is made of a plastic material such as expanded polystyrene (EPS). In other words, the holding element 60 is made of a flexible material. Therefore, the heating element 50 may be removed from the magnetic element 40 when desired by flexing the holding element 60.

The following is a summary list of reference numerals and the corresponding structure used in the above description of the invention.

REFERENCE LIST

10. Cooling device
20. Body
21. Front flange
210. Front wall
211. Inner planar surface
212. Outer planar surface
22. Storage compartment
23. Access opening
24. Inner sidewall
25. Outer sidewall
30. Door
31. Sealing element
40. Magnetic element
41. First surface
42. Second surface
50. Heating element
60. Holding element
61. First space portion
62. Second space portion
63. First fixing portion
64. Second fixing portion
70. Space
80. Adhesive means
H1. First height
H2. Second height
T. Thickness
X. Vertical direction
Y. Horizontal direction

The invention claimed is:

1. A cooling device, comprising:

a body having a front flange, wherein said body encloses a storage compartment and has an access opening formed therein and leading to said storage compartment;

a door operatively associated with said body for opening and closing said access opening of said storage compartment;

a sealing element for sealing an area between said body and said door;

a magnetic element being in contact with or attached to said front flange;

a heating element being at least partially in contact with said magnetic element; and at least one holding element defining a space for at least partly surrounding both said heating element and said magnetic element in a tight manner, said at least one holding element disposed to define a first space portion having a first height for holding both said heating element and said magnetic element therein, wherein said at least one holding element is disposed to define a second space portion having a second height smaller than the first height, for holding only a part of said magnetic element.

2. The cooling device according to claim 1, wherein said front flange has a front wall facing said door and an inner planar surface whereon said magnetic element is disposed, and wherein said front wall has an outer planar surface in contact with said sealing element when said door closes said access opening.

3. The cooling device according to claim 2, wherein both said heating element and said magnetic element extend on a portion of said inner planar surface in a vertical direction of said cooling device.

4. The cooling device according to claim 2, wherein both said heating element and said magnetic element extend on a portion of said inner planar surface in a horizontal direction of the cooling device.

5. The cooling device according to claim 2, wherein said at least one holding element has a first fixing portion which is parallel to said front wall, for fixing said at least one holding element to said inner planar surface at one side.

6. The cooling device according to claim 5, wherein said at least one holding element has a second fixing portion provided at an opposite side of said first fixing portion for fixing said at least one holding element to said inner planar surface.

7. The cooling device according to claim 5, further comprising an adhesive means disposed between said first fixing portion and said inner planar surface or between said second fixing portion and said inner planar surface.

8. The cooling device according to claim 7, wherein said adhesive means is double-sided tape.

9. The cooling device according to claim 1, wherein said at least one holding element is one of a plurality of holding elements disposed on said heating element.

10. The cooling device according to claim 1, wherein said heating element is a metal tube which transfers heat.

11. The cooling device according to claim 1, wherein said at least one holding element is made of a plastic material.

12. The cooling device according to claim 11, wherein said plastic material is expanded polystyrene (EPS).

13. A cooling device, comprising:

a body having a front flange, wherein said body encloses a storage compartment and has an access opening formed therein and leading to said storage compartment;

a door operatively associated with said body for opening and closing said access opening of said storage compartment;

a sealing element for sealing an area between said body and said door;

a magnetic element being in contact with or attached to said front flange and having a first surface and a second surface;

a heating element being at least partially in contact with said magnetic element; and at least one holding element defining a space for at least partly surrounding both said heating element and said magnetic element in a tight manner, wherein said at least one holding element is disposed to define a first space portion having a first height for holding both said heating element and said magnetic element therein, wherein said at least one holding element covers said second surface of said magnetic element so that said heating element is fixed in said first space portion between said at least one holding element and said second surface of said magnetic element.

14. A cooling device, comprising:

a body having a front flange, wherein said body encloses a storage compartment and has an access opening formed therein and leading to said storage compartment;

a door operatively associated with said body for opening and closing said access opening of said storage compartment;

a sealing element for sealing an area between said body and said door;

a magnetic element being in contact with or attached to said front flange;

a heating element being at least partially in contact with said magnetic element;

at least one holding element defining a space for at least partly surrounding both said heating element and said magnetic element in a tight manner, said at least one holding element disposed to define a first space portion having a first height for holding both said heating element and said magnetic element therein, wherein said at least one holding element is disposed to define a second space portion having a second height smaller than the first height, for holding only a part of said magnetic element; and said magnetic element having a thickness disposed such that said heating element is disposed between said magnetic element and a wall of said at least one holding element on a first side, and said magnetic element fills the second space portion on a second side.

* * * * *